US010730335B2

(12) United States Patent
Bartlett et al.

(10) Patent No.: US 10,730,335 B2
(45) Date of Patent: Aug. 4, 2020

(54) DUAL BINDING SYSTEM

(71) Applicant: ACCO Brands Corporation, Lake Zurich, IL (US)

(72) Inventors: Peter M. Bartlett, Spring Valley, OH (US); Patrick B. Nolan, Royersford, PA (US); Noah E. Dingler, Phoenixville, PA (US); Andrew J. Miller, Phoenixville, PA (US)

(73) Assignee: ACCO Brands Corporation, Lake Zurich, IL (US)

( * ) Notice: Subject to any disclaimer, the term of this patent is extended or adjusted under 35 U.S.C. 154(b) by 49 days.

(21) Appl. No.: 15/674,856

(22) Filed: Aug. 11, 2017

(65) Prior Publication Data

US 2018/0043721 A1 Feb. 15, 2018

Related U.S. Application Data

(60) Provisional application No. 62/374,291, filed on Aug. 12, 2016, provisional application No. 62/374,288, filed on Aug. 12, 2016, provisional application No. 62/414,513, filed on Oct. 28, 2016.

(51) Int. Cl.

| | |
|---|---|
| ***B42F 13/00*** | (2006.01) |
| ***B42B 5/12*** | (2006.01) |
| ***B42F 11/00*** | (2006.01) |
| ***B42F 13/26*** | (2006.01) |

(52) U.S. Cl.

CPC ..... *B42B 5/123* (2013.01); *B42B 5/12* (2013.01); *B42F 11/00* (2013.01); *B42F 13/26* (2013.01)

(58) Field of Classification Search

CPC .... B42F 13/0006; B42F 21/02; B42F 13/165; B42F 13/26; B42F 13/008; B42F 11/00; B42F 7/02; B42D 1/06; B42D 13/00

See application file for complete search history.

(56) References Cited

U.S. PATENT DOCUMENTS

| | | | | |
|---|---|---|---|---|
| 4,551,039 | A | 11/1985 | Basseches | |
| 5,186,565 | A | 2/1993 | Jack | |
| 5,393,154 | A | 2/1995 | Hubbell | |
| 5,524,998 | A | 6/1996 | Schwartz | |
| 5,597,256 | A | 1/1997 | Burton et al. | |
| 5,669,726 | A * | 9/1997 | Karlis | B42F 1/06 402/4 |
| 5,678,943 | A * | 10/1997 | Parsons | B42F 13/406 281/31 |
| 5,836,711 | A | 11/1998 | Stewart | |
| 5,876,144 | A * | 3/1999 | Bedol | B42D 5/042 281/38 |

(Continued)

FOREIGN PATENT DOCUMENTS

| | | |
|---|---|---|
| CN | 201111469 | 9/2008 |
| WO | 2015/023758 | 2/2015 |

*Primary Examiner* — Shin H Kim

(74) *Attorney, Agent, or Firm* — Fitch, Even, Tabin & Flannery LLP

(57) ABSTRACT

A component system comprising a component and a first binding system coupled to the component and configured to be coupled to a first type of a binding mechanism. The system further includes a second binding system movably coupled to the component and configured to be coupled to a second type of binding mechanism that is different from the first type of binding mechanism.

23 Claims, 12 Drawing Sheets

(56) References Cited

U.S. PATENT DOCUMENTS 6,196,750 B1 * 3/2001 Hansen ..... B42F 3/003 402/79
6,209,778 B1 4/2001 Henrikson et al.
6,390,713 B1 5/2002 Moor et al.
6,431,780 B2 8/2002 Moor et al.
6,499,903 B1 * 12/2002 Schwartz ..... B42F 11/00 281/38
6,672,785 B1 1/2004 O'Hara et al.
7,021,853 B2 * 4/2006 Hall ..... B42F 13/0006 206/232
7,025,381 B2 * 4/2006 Lockhart ..... B42B 5/10 281/29
7,628,426 B1 * 12/2009 Rowe ..... B42F 11/00 281/29
7,789,290 B2 9/2010 Hsieh
7,819,432 B2 * 10/2010 Rowe ..... B42F 11/00 281/21.1
8,141,907 B2 * 3/2012 Seiffarth ..... B42F 7/02 281/20
8,702,128 B2 * 4/2014 Rowe ..... B42F 11/00 281/21.1
9,796,206 B2 * 10/2017 Busam ..... B42D 1/06
9,902,188 B2 * 2/2018 Busam ..... B42D 1/06
2001/0028822 A1 * 10/2001 Moor ..... B42D 5/042 402/60
2004/0120754 A1 * 6/2004 Lockhart ..... B42B 5/10 402/73
2006/0054669 A1 3/2006 Hsieh
2006/0285914 A1 * 12/2006 Bassford ..... B42D 5/006 402/79
2009/0054669 A1 2/2009 Tanaka et al.
2009/0236842 A1 * 9/2009 Rowe ..... B42F 11/00 281/21.1
2010/0322701 A1 * 12/2010 Butterfield ..... B42B 5/10 402/19
2014/0183851 A1 * 7/2014 Busam ..... B42D 1/06 281/21.1
2015/0041526 A1 * 2/2015 Busam ..... B42D 1/06 229/67.1

* cited by examiner

DUAL BINDING SYSTEM

This application is directed to a binding system, and more particularly, to a binding system that enables components to be attached or bound to differing types of binding mechanisms.

This application claims priority to U.S. Provisional Patent Application Ser. No. 62/374,291 filed on Aug. 12, 2016 and entitled Dual Binding System; and U.S. Provisional Patent Application Ser. No. 62/374,288 filed on Aug. 12, 2016 and entitled Folder with Movable Divider; and U.S. Provisional Patent Application Ser. No. 62/414,513 filed on Oct. 28, 2016 and entitled Dual Binding System. The entire contents of all three U.S. provisional applications are hereby incorporated by reference.

BACKGROUND

Components such as dividers, pockets, pouches, portfolios, binders, files, notebooks, notepads, folders, sleeves, covers or the like may be desired to be coupled to a binding mechanism. It may also be desired to couple such components to more than one type of binding mechanism. However, many existing components are configured to be coupled to only a single type of binding mechanism.

SUMMARY

In one embodiment, the present invention is a binding system that enables components to be attached or bound to differing types of binding mechanisms. More particularly, in one embodiment the invention is a component system comprising a component and a first binding system coupled to the component and configured to be coupled to a first type of a binding mechanism. The system further includes a second binding system movably coupled to the component and configured to be coupled to a second type of binding mechanism that is different from the first type of binding mechanism.

DETAILED DESCRIPTION

Figure 1:
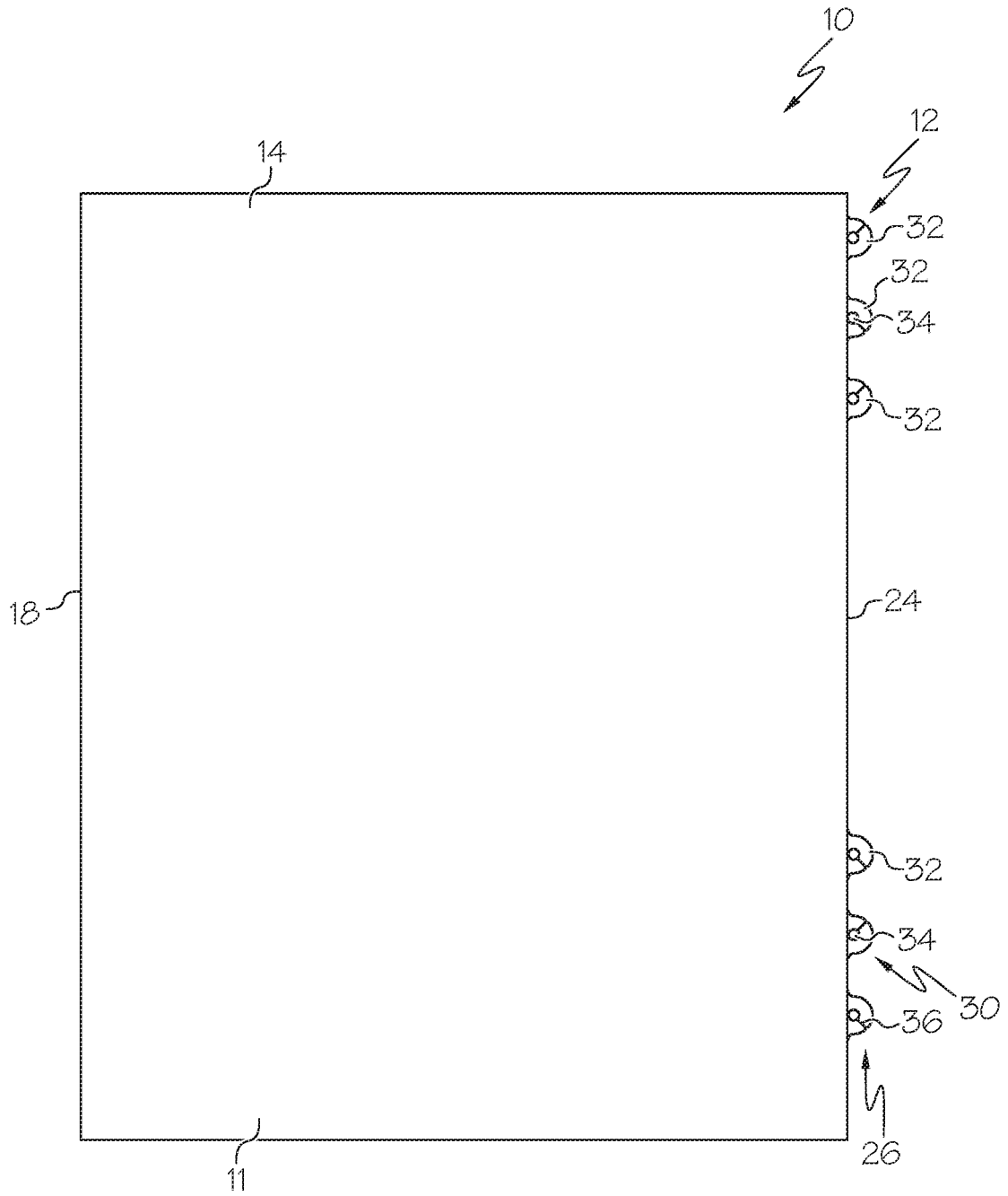
FIG. 1 is a front view of a folder with one embodiment of a dual binding system in a retracted position.
Figure 6:
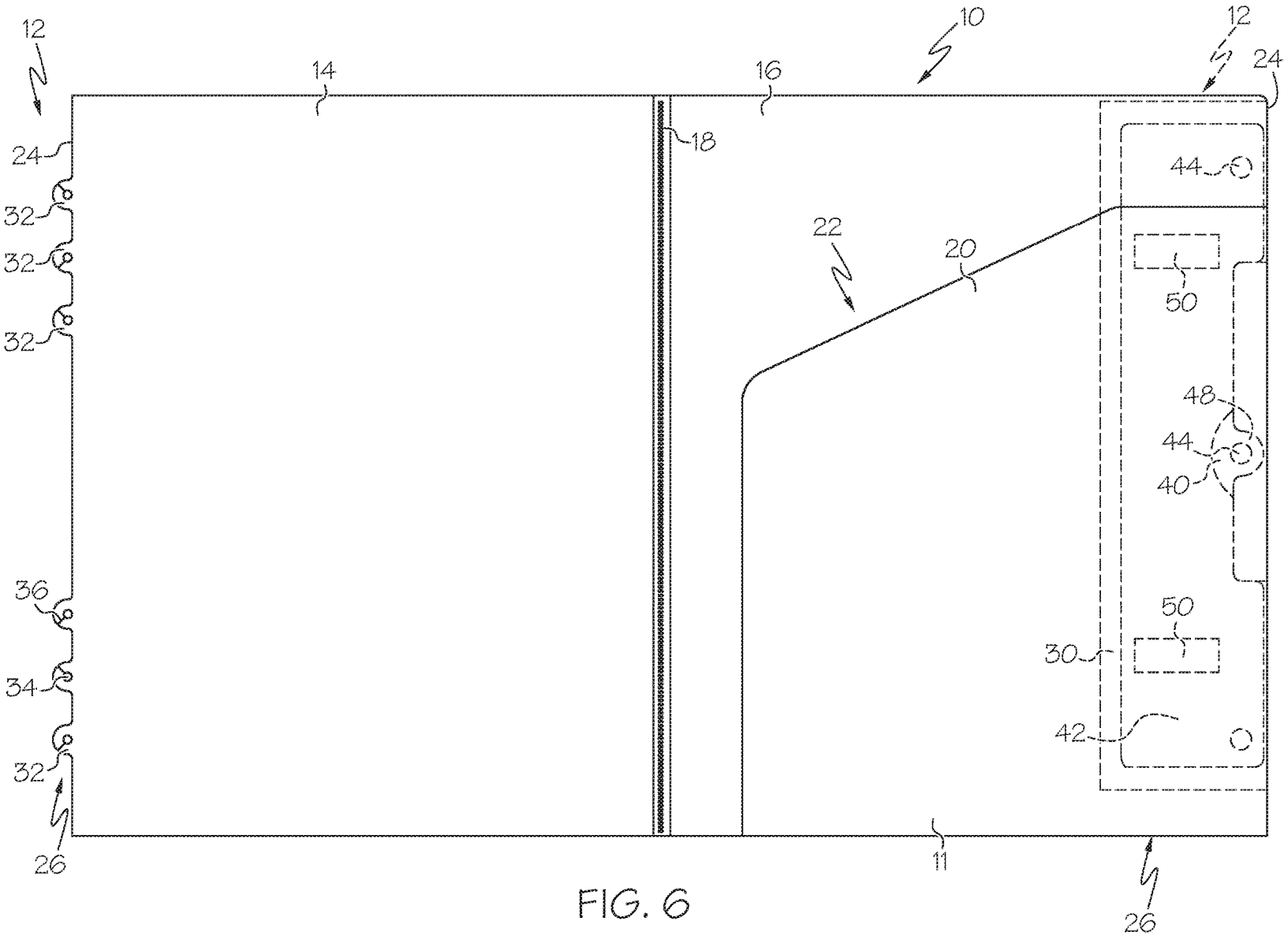
FIG. 6 illustrates an alternate embodiment of the folder of FIG. 1 in an open position.

FIG. 1 illustrates a component 10 in the form of a folder with a dual binding system or device 12. With reference to FIG. 6, in one embodiment the folder 10 can include a body 11 having a first or front main panel 14 and a second or back 16 main panel pivotally coupled along a pivot/hinge line or area 18. Each main panel 14, 16 can include a pocket panel 20 coupled thereto and forming a pocket 22 therewith, although a pocket panel 20/pocket 22 is shown only on back main panel 16 in FIG. 6. The folder 10 is pivotable about the hinge line 18 and positionable in a closed position, as shown in FIG. 1, wherein the main panels 14, 16 are aligned/overlapping with the pocket(s) 22 positioned therebetween. The folder 10 is also positionable in an open position, as shown in FIG. 6, wherein the main panels 14, 16 are not aligned/overlapping and instead are positioned adjacent each other in a parallel side-by-side configuration, providing access to the pocket(s) 22.

The folder 10 can be generally rectangular in front/top view, and when in the closed position can include an inner/binding edge 24, which is positioned on an opposite side of the folder 10 relative the pivot line 18 in the illustrated embodiment. However, the binding edge 24 can be positioned along any outer edge of the folder 10, including along or adjacent to the pivot line 18 if desired. Moreover, as will be described in greater detail below, the component 10 can take any of a variety of other forms besides the folder described and shown herein.

Figure 2:
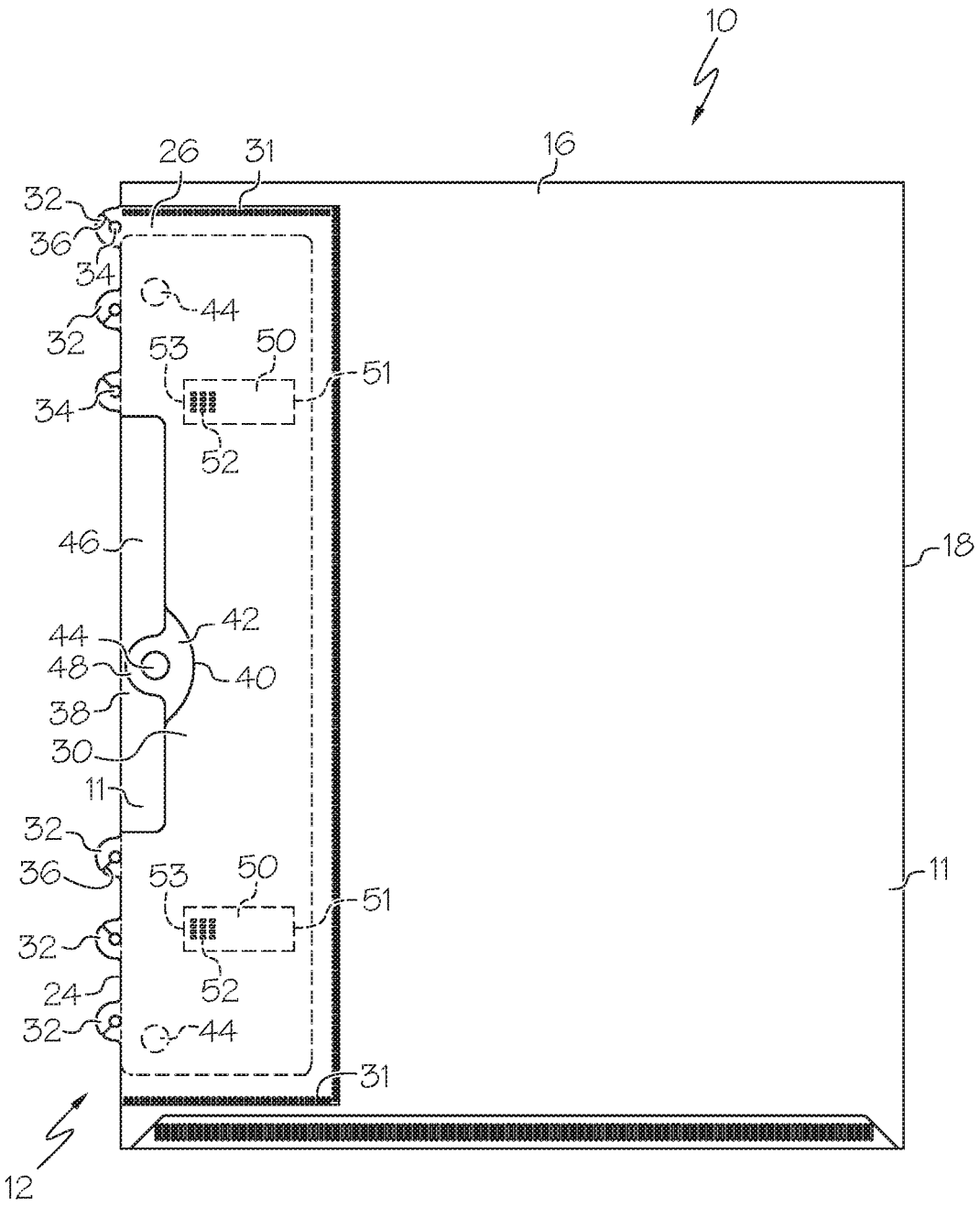
FIG. 2 is a back view of the folder of FIG. 1.
Figure 3:
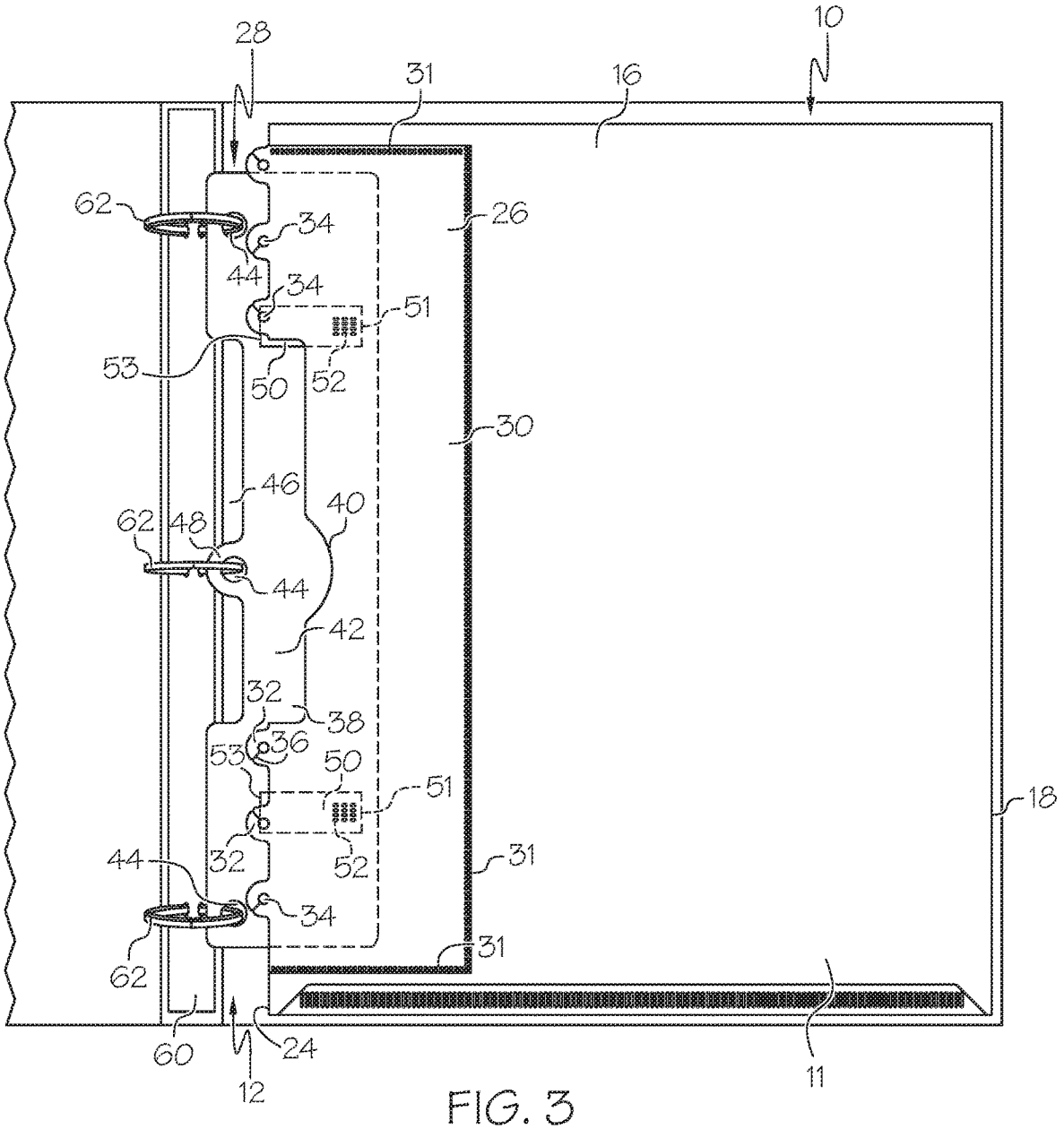
FIG. 3 illustrates the folder of FIG. 2 with the binding system in an extended position and bound to a three ring binder.
Figure 4:
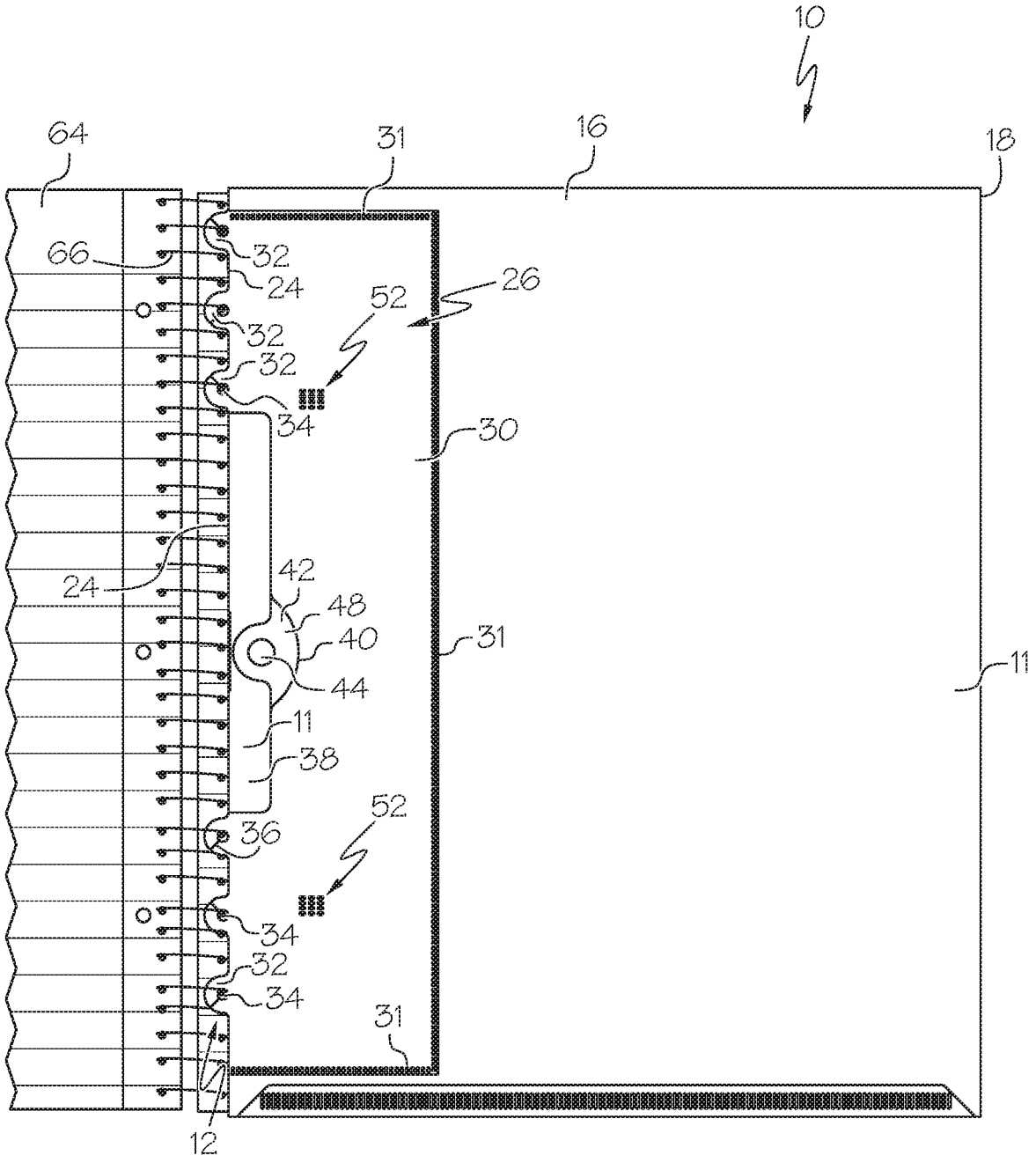
FIG. 4 shows the folder of FIG. 2 bound to a spiral bound notebook.
Figure 5:
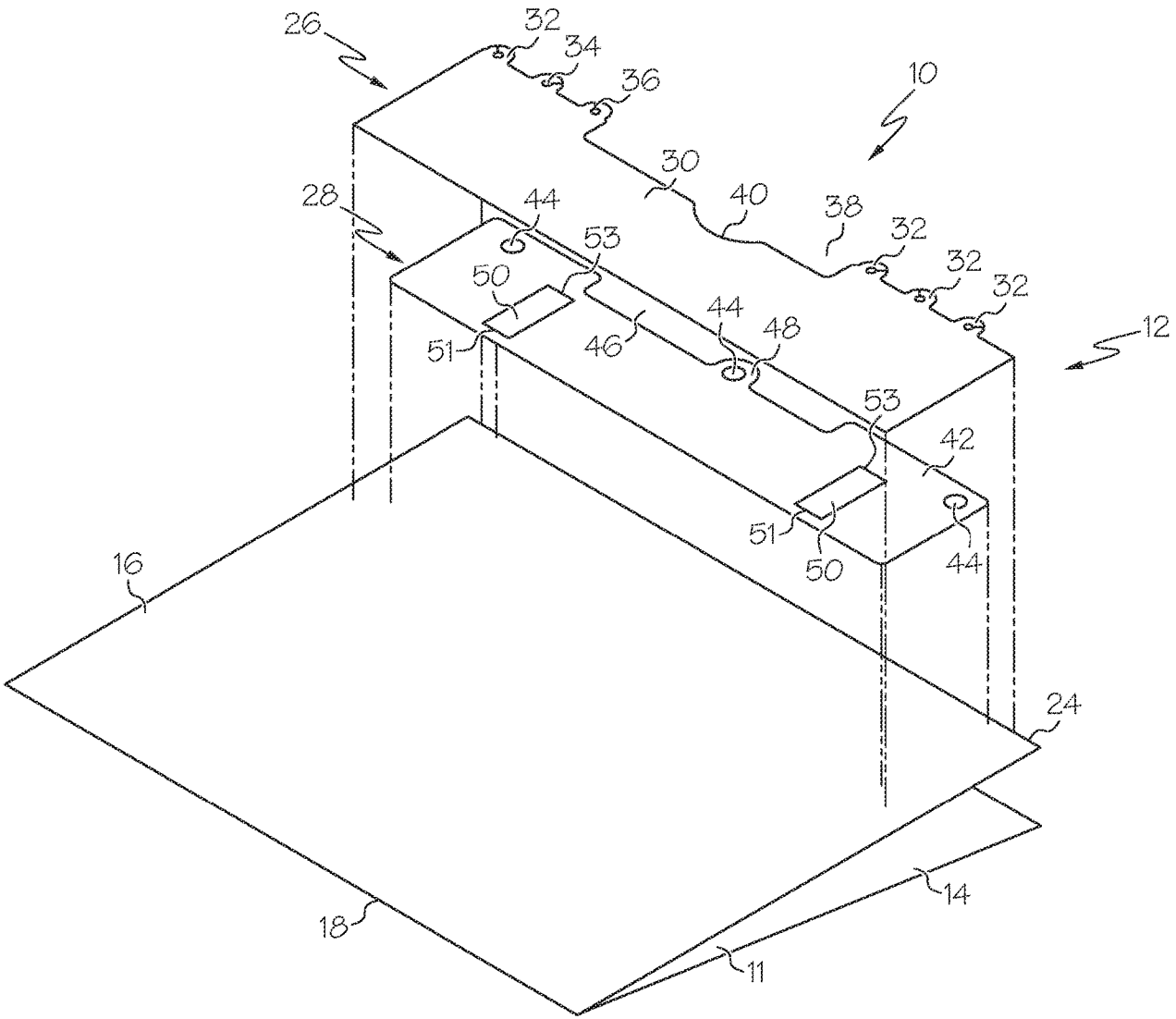
FIG. 5 is a perspective exploded view of the binding system of FIG. 2.

With reference to FIG. 5, the dual binding system 12 can include a first binding system 26 and a second binding system 28. The first binding system 26 can include a generally rectangular panel 30 which is attached to the folder 10 (attached to a back surface of the back main panel 16 in the illustrated embodiment). In one embodiment the panel 30 of the first binding system 26 is coupled to the folder 10/second main panel 16 along three sides of the panel 30, along weld lines or lines of attachment 31 as shown in FIGS. 2-4 for example. In this case, the panel 30 of the first binding system 26 is permanently, fixedly and/or non-removably coupled to the folder 10/second main panel 16 (e.g. cannot be removed without causing damage to the panel 30 and/or folder 10).

The panel 30 of the first binding system 26 can include a plurality of protrusions 32 (six protrusions 32 in the illustrated embodiment), where each protrusion 32 has a hole or opening 34 positioned therein and extending through the protrusion 32/panel 30. In the illustrated embodiment each protrusion 32 includes a slit 36 extending from an outer edge of the protrusion 32 to the opening 34, for purposes which will be described in greater detail below. With reference to FIG. 5, the panel 30 of the first binding system 26 can also include a recessed area 38 and a generally arcuate cut-out 40 positioned in the recessed area 38.

Again with reference to FIG. 5, the second binding system 28 can include a panel 42 that is positioned between the panel 30 of the first binding system 26 and the folder 10 in a thickness direction of the folder 10. The panel 42 of the second binding system 28 can be generally rectangular and include three holes or openings 44 spaced along a length thereof. The panel 42 of the second binding system 28 can also include a recessed area 46 that is generally aligned with the recessed area 38 of the panel 30 when the panel 42 is positioned as shown in FIG. 2. The panel 42 can include a protrusion 48 positioned in/protruding into the recessed area 46, where the protrusion 48 includes one of the openings 44 therein.

The panel 42 of the second binding system 28 can also include a plurality (at least two in one case) of spaced slots 50 that extend perpendicular to a length of the panel 42. Each slot 50 can have an inner edge 51 and an outer edge 53.

The dual binding system 12 (i.e. including the panels 30, 42) can be made of any of a wide variety of materials, including but not limited to plastic (such as polypropylene or vinyl), cardboard, cellulose-based materials, paperboard, plastic encased cardboard, etc.

In order to assemble the dual binding system 12, the panel 42 of the second binding system 28 is positioned between the folder 10 and the panel 30 of the first binding system 26, as shown in FIG. 5. The panel 30 of the first binding system 26 is then secured to the folder 10, such as about the weld lines 31 as shown in FIGS. 2-4, thereby trapping the panel 42 of the second binding system 28 in place, but the weld lines 31 can be spaced away from the panel 42 such that the panel 42 remains movable relative to the folder 10 and panel 30. The panel 30 of the first binding system 26 can also be secured to the folder 10 at two spaced apart coupling locations 52 (FIGS. 2 and 3), which are also weld areas in the illustrated embodiment. Each coupling location 52 is positioned in one of the slots 50 of the panel 42 of the second binding system 28.

By securing the dual binding system 12 to the folder 10 in this manner, the panel 30 of the first binding system 26 is fixedly, permanently and/or non-movably coupled to the folder 10, while the panel 42 of the second binding system 28 is movably (and more particularly slidably) but non-removably coupled to the folder 10. In particular, the second binding system 28/panel 42 is slidable/movable to a retracted position, as shown in FIGS. 2 and 4, where the panel 42 (or at least the openings 44 of the panel 42) is generally covered by or recessed within by the panel 30, behind the inner/binding edge 24. The second binding system 28/panel 42 is also movable to an extended position, as shown in FIG. 3, where at least portions of the panel 42 (or at least the openings 44) extend beyond or are positioned beyond the panel 30 or inner/binding edge 24, and are exposed/uncovered and available for use. When the second binding system 28 is in its extended position, the holes 44 can be positioned outwardly beyond the holes 34 and/or associated protrusions 32 of the first binding system 26 so that the first binding system 26 and/or its protrusions 32 do not interfere with access to or use of the holes 44 of the second binding system 28.

When the panel 42 is in its retracted position each coupling location 52 is positioned adjacent to an outer edge 53 of an associated slot 50 (FIGS. 2 and 4), and when the panel 42 is in its extended position each coupling location 52 is positioned adjacent to an inner edge 51 of an associated slot 50 (FIG. 3). The edges 51, 53 of the slot 50 may engage the coupling locations 52 when the panel 42 is in its retracted or extended positions. In this manner the slots 50/coupling locations 52 cooperate to guide and limit the sliding movement of the panel 42 between the retracted and extended positions. The slots 50 extend in a direction parallel to the direction of movement of the panel 42 to define the range of movement thereof. However it should be understood that the second binding system 28/panel 42 can be slidably or movably coupled to the folder 10 and/or first binding system 26/panel 30 by any of a wide variety of systems and methods. For example, in one case the second binding system 28/panel 42 can be hingedly or pivotally coupled to the folder 10 and/or first binding system 26/panel 30.

With reference to FIG. 2, when the second binding system 28/panel 42 is in its retracted position, the holes 44 can be retracted within and/or covered by the first binding system 26/panel 30 and/or the holes 44 are retracted behind the binding edge 24 of the folder 10 and/or positioned within the footprint of the folder 10 in front or top view. In this case the panel 42 and/or holes 44 are generally protected from damage and not available for use with a binding mechanism.

When the second binding system 28/panel 42 is in its retracted position, the protrusion 48 of the panel 42 is positioned within, and protrudes at least partially into, the recessed area 38 of the panel 30. In this manner at least part of the protrusion 48/panel 42 is exposed and manually accessible so that a user can grasp the protrusion 48 to move the second binding system 28/panel 42 from its retracted positioned to its extended position. While the center protrusion 48 allows the panel 42 to be pulled from its retracted to its extended position, it should be understood that the panel 42 can be moved from its retracted to its extended position by various other structure or methods, such as providing a surface or tab that can be pushed to extend the panel 42.

With reference to FIG. 3, when the second binding system 28/panel 42 is in its extended position, in one case the holes 44 are positioned outwardly/beyond and/or are not covered by the first binding system 26/panel 30 and/or the holes 44 are positioned outwardly/beyond binding edge 24 of the folder 10 and/or are not positioned within the footprint or outer perimeter of the folder 10 in top view. In this position the panel 42 and/or holes 44 are exposed and available for use with a binding mechanism. Thus when the second binding system 28 is in its extended position the holes 44 of the panel 42 of the second binding system 28 can be used to bind the folder 10 to a ring binding mechanism/binder, such as a three ring binding mechanism/binder 60. The rings 62 of the ring binding mechanism 60 may be separable/openable so that each ring 62 can be passed through the associated opening 44, and the ring binding mechanism 60 can then be closed. In this case the second binding system 28/holes 44 may not need any slits. However, if desired the second binding system 28/holes 44 can utilize slits in conjunction with the holes 44 in the same or a similar manner as the slits 36 described above in conjunction with the holes 34 of the first binding system 26.

In one case the panel 42 of the second binding system 28 can have three holes 44, where each hole 44 is spaced apart from any adjacent hole 44 by about 4.25 inches to correspond to a traditional three ring binding mechanism 60. However, the panel 42 can have any of a variety of number of holes 44 and relative spacing to account for use with differing binding mechanism, such as providing two holes 44 spaced apart by about 70 mm, or about 80 mm, or other dimensions for use with two hole binding mechanisms, or can include four or more holes 44.

When the second binding system 28 is in its retracted position, as shown in FIG. 4, the holes 34 of the panel 30 of the first binding system 26 can be used to bind the folder 10 to a wire binding mechanism/notebook 64, such as a spiral or helical binding mechanism 66, or a twin wire binding mechanism. Thus when the second binding system 28 is in its retracted position, the panel 42 of the second binding system 28 can be retracted behind the holes 34 so that second binding system 28 does not interfere with access to or use of the holes 34. The holes 34 of the first binding system 26 can be smaller than the holes 44 of the second binding system 28 since the wire of the spiral binding mechanism 66 is typically of a smaller size/diameter than a size/diameter of the rings 62 of the ring binding mechanism 60. In addition, since most wire binding mechanisms are permanent binding mechanisms and are not openable/closeable, the slits 36 enable a turn or coil of the wire binding mechanism 66 to pass therethrough and enter an associated opening 34 to thereby bind/couple the first binding system 26 to the wire binding mechanism 66. The second binding system 28 can also be used to bind the folder 10 to other bound devices, such as relatively small diameter openable binding mechanisms.

In this manner the dual binding system 12 enables the folder 10 to be easily coupled to a first type of binding mechanism when the second binding system 28 is in its retracted position, and enables the folder 10 to be easily coupled to a second type of binding mechanism when the second binding system 28 is in its extended position. In addition the dual binding system 12 is movable between the two configurations in an easy and intuitive manner, is relatively easy to manufacture and assemble, and is relatively durable.

While the dual binding system 12 is disclosed as being used in conjunction with a component in the form of a folder 10, it should be understood that the dual binding system 12 can be coupled to and/or used in conjunction with, any of a wide variety of components, such as dividers, pockets, pouches, portfolios, planners, date books, binders, files, notebooks, notepads, folders, sleeves or covers, or other school, office or organization products or devices. Thus in some cases the component need not be two-ply (such as the disclosed folder 10) and/or need not have movable covers or the like, and can simply take the form of a single-ply sheet such as a divider. Furthermore, if desired the dual binding system 12 can be manufactured and sold by itself as a stand-along component that is attachable to a component 10, for example by an adhesive or the like. In this case the panel 30 of the first binding system 26 may take the form of a sleeve or the like which slidably receives the panel 42 of the second binding system 28 therein.

Figure 7:
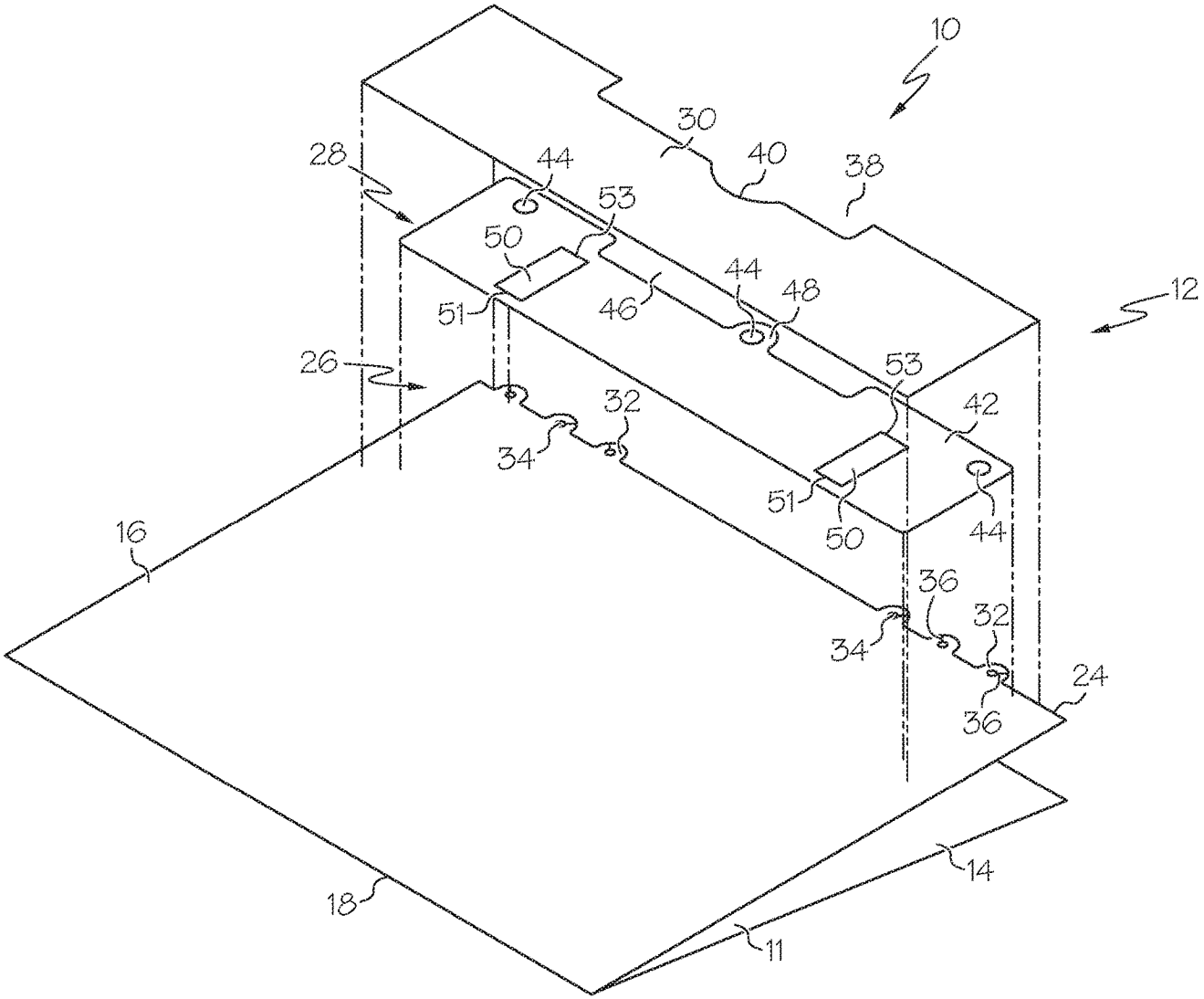
FIG. 7 illustrates an alternate embodiment of the folder of FIG. 5.

As shown in FIG. 7, rather than positioning the protrusions 32/openings 34 on the panel 30, the protrusions 32/openings 34 can be coupled to and/or integrally formed as part of the folder 10 or other component, such as the back main panel 16 (e.g. the protrusions 32 can be formed seamlessly as a one-piece piece of material with said folder 10 or back panel 16). In this case, the panel 30 may lack the protrusions 32/openings 34 and may instead be utilized primarily to capture/couple the panel 42 of the second binding system 28 to the folder 10. In a further alternate embodiment shown in FIG. 6, the protrusions 32 of the first binding system 26 are positioned on the first main panel 14 while the panel 42 of the second binding system 28 is positioned on the second main panel 16. In a yet further alternative embodiment, some of the protrusions 32 can be positioned on the first main panel 14, and others of the protrusions 32 of the first binding system 26 can be positioned on the second main panel 16. In this case the folder 10 can be generally retained in the closed positioned when the folder 10 is bound by the first binding system 26. In addition, it should be understood that the hole position/protrusions 32/48 can be reversed from that shown herein. In particular, the protrusions 32/holes 34 for use with a wire binding mechanism could be located on the second (movable) binding system 28, and the protrusion 48/holes 44 for use with a three ring binder could be located on the first (fixed) binding system 26.

Figure 8:
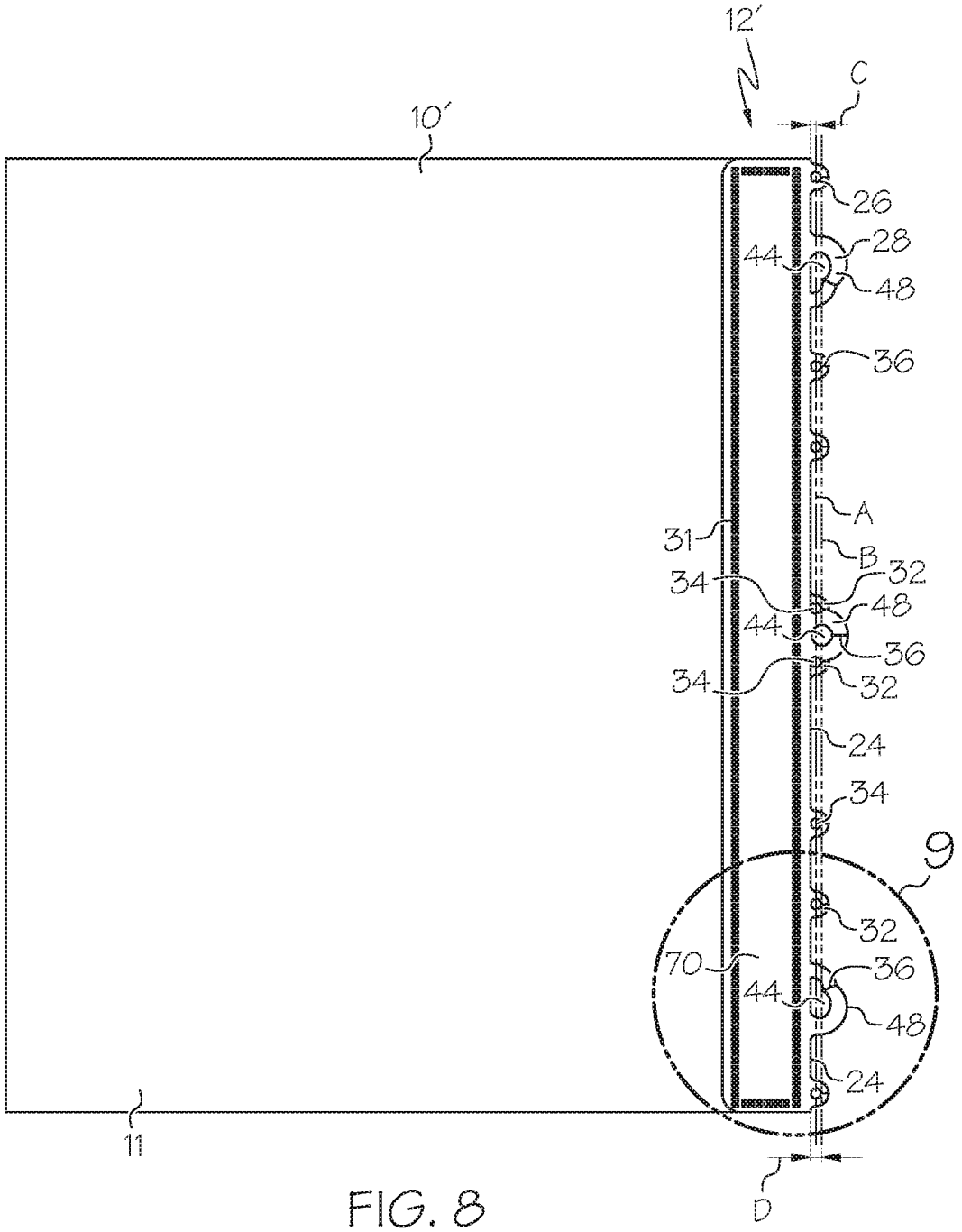
FIG. 8 is a back view of a folder with another embodiment of the dual binding system.
Figure 9:
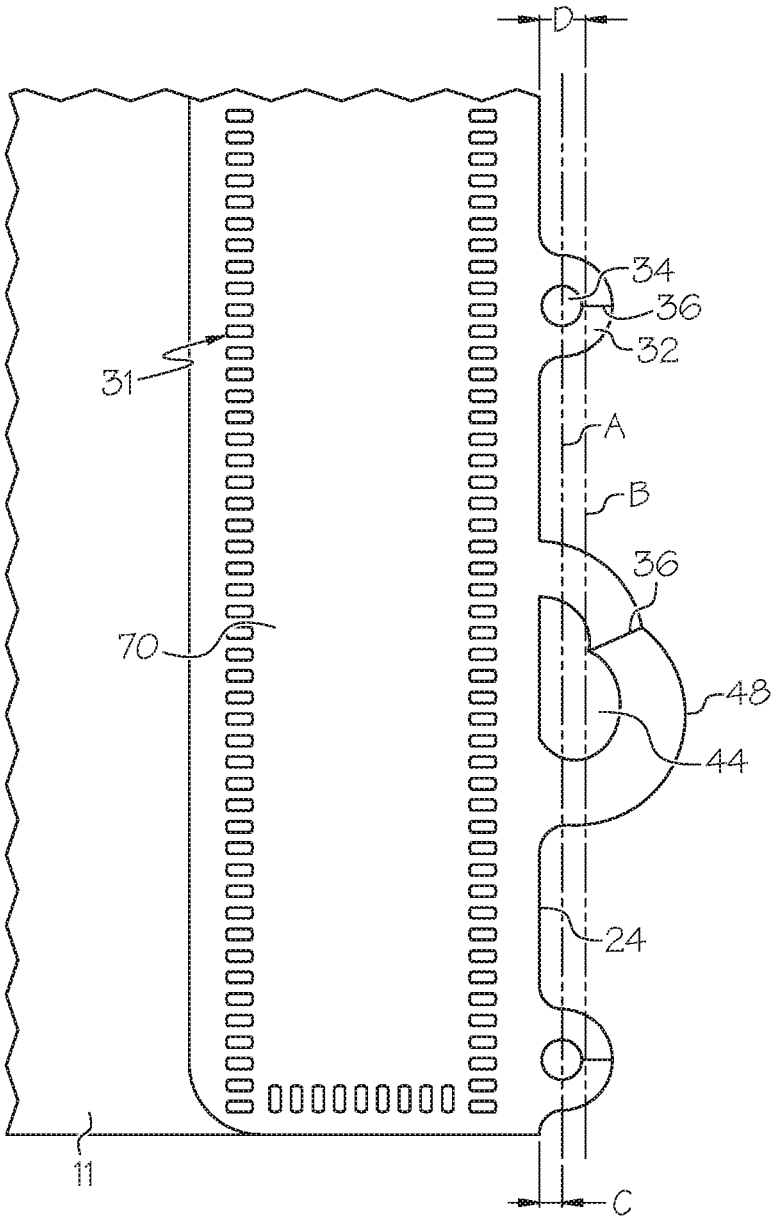
FIG. 9 is a detail view of the area indicated in FIG. 8.
Figure 10:
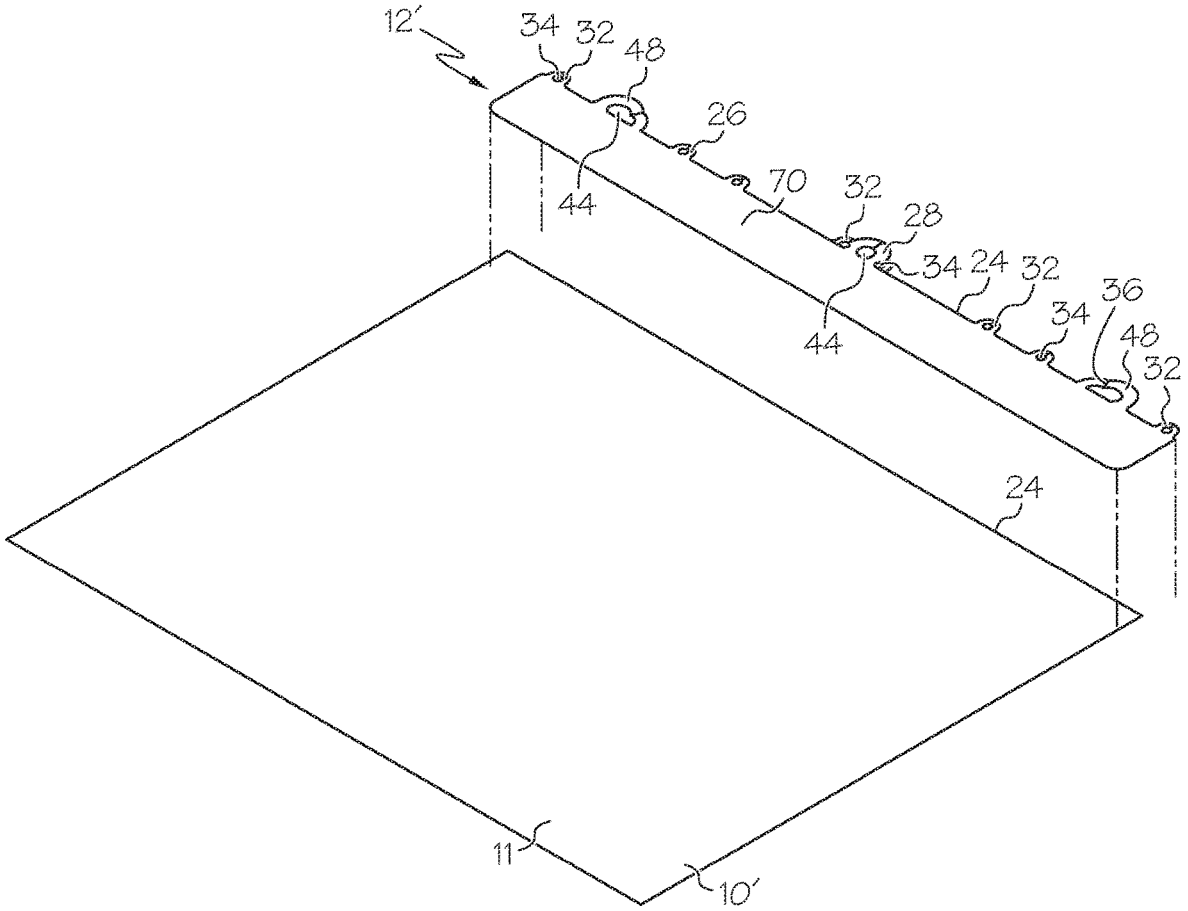
FIG. 10 is an exploded view of the folder of FIG. 8.

FIGS. 8-12 illustrate an alternate embodiment of the dual binding system 12'. In this case the dual binding system 12' can include the first 26 and second 28 binding systems, each of which are fixedly (and not movably, or more particularly, not movable in translation) coupled to the component 10' (shown in this case as a divider) along the inner/binding edge 24. As shown in FIG. 10, in one embodiment the first 26 and second 28 binding systems are coupled to or part of a strip or panel 70, which is in turn coupled to the body 11 of the component 10' by welding lines 31, adhesives, or other joining systems or methods. However, the dual binding system 12' can instead be integrally formed with the component 10' or attached by various other methods.

In the illustrated embodiment the first binding system 26 of FIGS. 8-12 can include a plurality of protrusions 32/openings 34/slits 36 in the same manner or similar as those of the first binding system 26 described above and shown in FIGS. 1-7. The protrusions 32/openings 34 can however have a different spacing from that shown in FIGS. 1-6 to avoid interference with the components of the second binding system 28. In addition the embodiment of FIGS. 8-12 includes a pair of center protrusions 32/openings 34 positioned on either side of a central protrusion 48/hole 44 of the second binding system 28.

The second binding system 28 can include a set of three protrusions 48/openings 44 with a spacing corresponding to the desired binding mechanism, such as a three ring binding mechanism 60 as outlined above. Since the second binding system 28 can be configured to be used with a three ring binding mechanism or the like, the holes 44/protrusions 48 may be larger and/or spaced further away from the inner/binding edge 24 of the component 10' than the protrusions 32/openings 34.

In particular, in one case and with reference to FIGS. 8 and 9, the first binding system 26 includes a plurality of openings 34 having centers aligned along a center line A, where the center line A is oriented parallel or generally parallel to the inner/binding edge 24 and spaced apart a first distance C thereof. The openings 44 of the second binding system 28 can have centers aligned along a center line B thereof, where the center line B is oriented parallel or generally parallel to the inner/binding edge 24 and spaced apart a distance D thereof. In the illustrated embodiment, the distance D is greater than distance C, and is greater by at least about 25% but less than about 150% in one case, to provide positioning sufficient to accommodate and be secure to differing binding mechanisms. Since the openings 34, 44 (in particular the openings 44 of the second binding system 28) can be irregular or asymmetrical, in this case the "center" of an opening 34, 44 can be an effective or geometric center and/or considered to be the center of "mass" in top view or a centroid of the hole 34, 44.

In one case the distance C is between about 0.02 inches and about 0.20 inches, and about 0.07 inches in an exemplary embodiment. In one case the distance D is between about 0.08 inches and about 0.40 inches, and about 0.15 inches in an exemplary embodiment. In one case the distance D is greater than the distance C, although this need not necessarily be the case, and indeed in one case the distance D is the same as distance C. These spacings can provide positioning of the holes sufficient to accommodate and enable the binding systems 26, 28 to be secured to differing binding mechanisms. The openings 34, 44 of the first binding system 26 and the second binding system 28 can both be positioned outside of the body 11 (e.g. an outer perimeter of the body 11) or outside the inner edge 24 of the component 10' to provide access to the holes 34, 44 for binding purposes.

Figure 11:
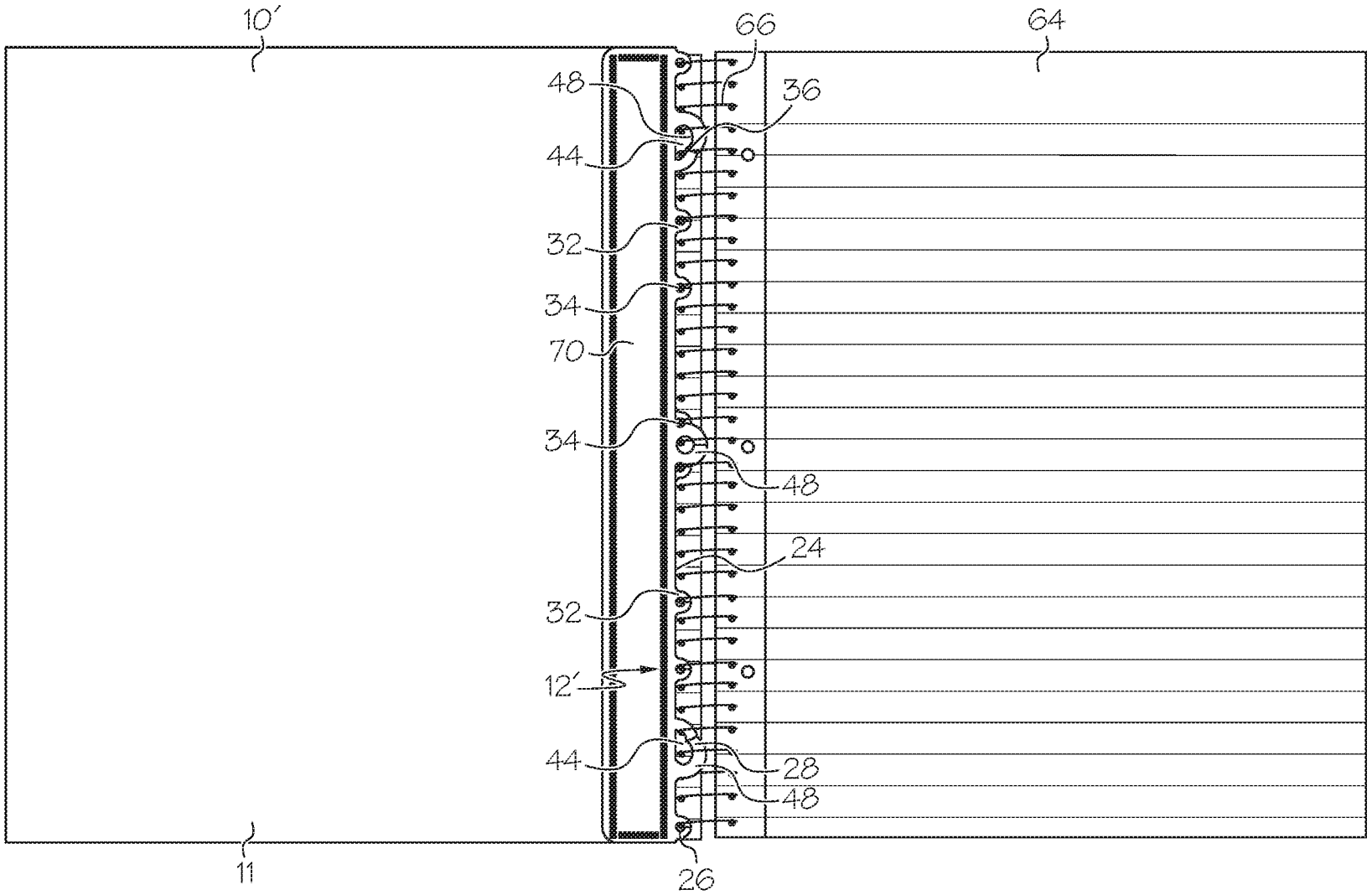
FIG. 11 illustrates the folder of FIG. 8 bound to a spiral bound notebook.

As shown in FIG. 11, the dual binding system 12' can be used to couple the component 10' to a helical, spiral, wire, or twin-wire binding mechanism 66. In this case a single turn or coil of the binding mechanism 66 can be received through one or more of each opening 34 of the first binding system 26 to bind the component 10' to the binding mechanism 66. In addition, in this case one or more turns or coils of the binding mechanism 66 can be passed through each opening 44/protrusion 48 of the second binding system 28 to further secure the component 10' to the binding mechanism 66 and/or to avoid the second binding system 28 from interfering with use/binding of the component 10'. In this case, then, each opening 44/protrusion 48 of the second binding system can include a slit 36 to enable such use.

Figure 12:
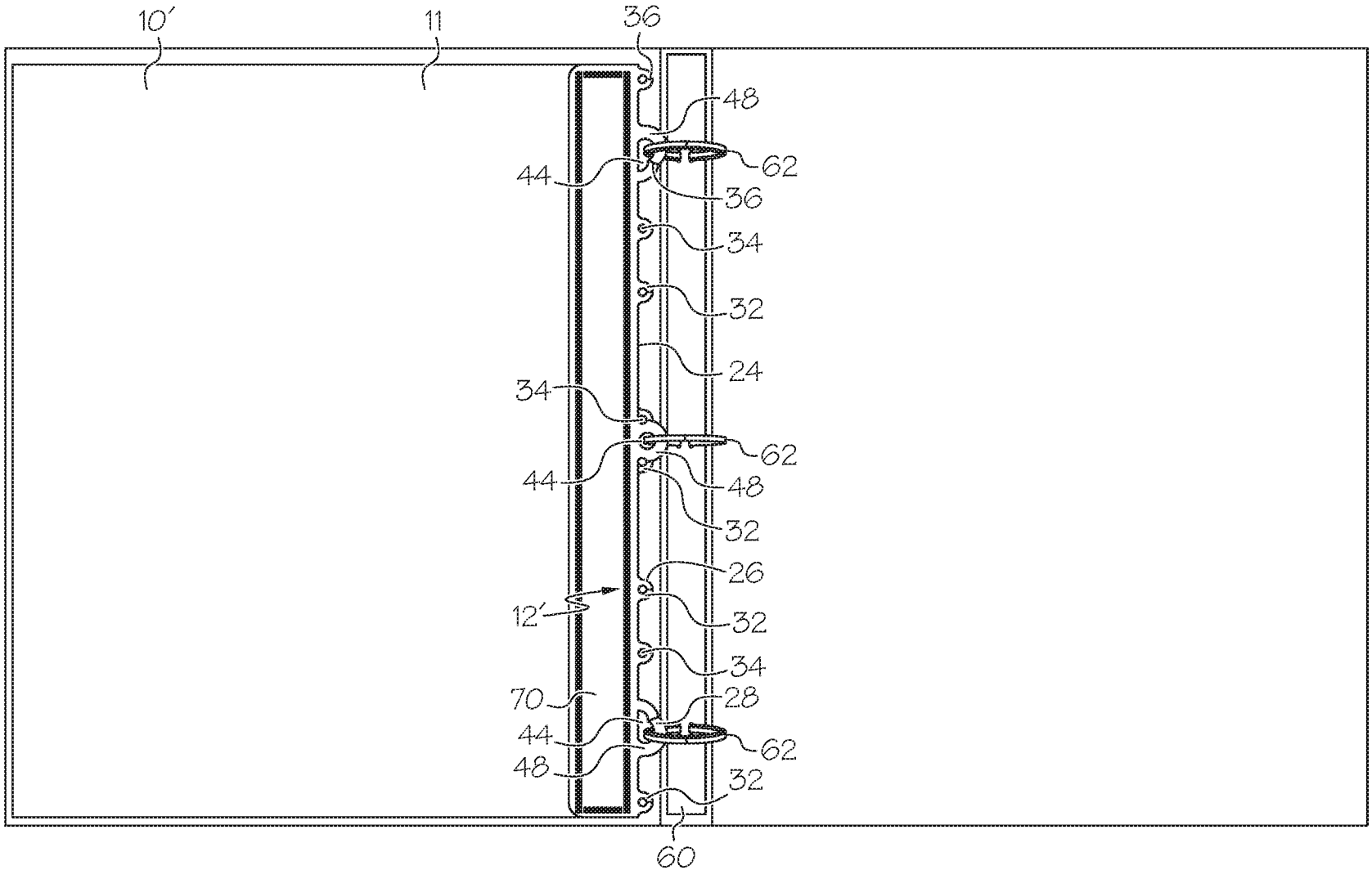
FIG. 12 illustrates the folder of FIG. 8 bound to a three ring binder.

As shown in FIG. 12, the dual binding system 12' can also be used to couple the component 10' to an alternate binding mechanism, such as a three ring binding mechanism 60. Each ring 62 can be received through each opening 44 of the second binding system 28 to bind the component 10' to the binding mechanism 60. In this case the first binding system 26 may not be utilized (e.g. no part of the binding mechanism 60 is received through the first binding system 26/openings 34) but the first binding system 26 does not interfere with use of or access to the second binding system 28.

In one case each opening 44 of the second binding system 28 has an outer portion that is configured to receive a ring 62 therethrough, as shown in FIG. 12. However, the end or outer-most openings 44 may also each have an inner portion that is sized to receive two adjacent turns or coils of a wire binding mechanism 66 therethrough, as shown in FIG. 11, to ensure compatibility with the wire binding mechanism 66. This can lead in one case to openings 44 that are asymmetrically-shaped (e.g. in one case asymmetrical with respect to a line extending parallel to the binding edge 24) such as the top and bottom asymmetric openings 44 in FIGS. 8-12. In this case, for example, each opening 44, at portions closer to the binding edge 24, has a greater length/extent than portions of the opening 44 at a position further away from the binding edge 24. Alternatively, one or more of the openings 44, such as the center opening 44, can be symmetrical and relatively small and sized to receive only a single turn of a wire binding mechanism 66. In this case as shown two protrusions 32/openings 34 can be positioned on either side thereof. The size and spacing of the openings 34, 44 can vary depending upon the shape and configuration of the associated binding mechanisms. In one case each opening 44 of the second binding system 28 can have a size that is at least 50% larger in one case, or at least double in size in another case, of each opening 34 of the first binding system 26.

Thus the system of FIGS. 8-12 enables the system/component 10' to be bound to at least two different binding mechanisms, and in this embodiment the system/component 10' is always configured for use with the differing binding mechanisms, and does not require movement or adjustment by a user to be adapted for use with differing binding mechanisms.

Having described the invention in detail and by reference to the various embodiments, it should be understood that modifications and variations thereof are possible without departing from the scope of the claims of the present application.

What is claimed is:

1. A component system comprising:

a component;

a first binding system non-slidably coupled to said component and configured to be selectively coupled to a first binding mechanism; and a second binding system slidably coupled to said component and movable between an extended position and a retracted position, the second binding system configured to be selectively coupled to a second binding mechanism that is different from said first binding mechanism.

2. The component system of claim 1 wherein said first binding system is fixedly and non-movably coupled to said component.

3. The component system of claim 1 wherein said first binding system includes a plurality of binding holes configured to be selectively coupled to said first binding mechanism and wherein said second binding system includes a plurality of binding holes of a different size and spacing than said holes of said first binding system, the binding holes of said second binding system configured to be selectively coupled to said second binding mechanism.

4. The component system of claim 1 wherein the extended position of the second binding system permits the second binding system to be selectively coupled to the second binding mechanism, and wherein the retracted position of the second binding system inhibits the second binding system from being coupled to the second binding mechanism.

5. The component system of claim 1 wherein said component has a binding edge; and wherein said second binding system has a plurality of binding holes, the binding holes configured to extend at least partially beyond the binding edge of the component in the extended position and not extend beyond the binding edge of the component in the retracted position.

6. The component system of claim 1 wherein said first binding system includes a panel coupled to said component, said panel including a plurality of binding holes extending therethrough.

7. The component system of claim 6 wherein said second binding system includes a panel positioned between said panel of said first binding system and said component, and wherein said panel of said second binding system includes a plurality of binding holes extending therethrough.

8. The component system of claim 1 wherein said component includes one or a combination of a divider, a pocket, a pouch, a portfolio, a planner, a date book, a binder, a file, a notebook, a notepad, a folder, a sleeve, and a cover.

9. The component system of claim 1 wherein said component has a first main panel hingedly coupled to a second main panel, and wherein said first and second binding systems are located on a same one of said first main panel or said second main panel.

10. The component system of claim 1 wherein said component includes a binding edge, wherein said first binding system is positioned adjacent to and oriented parallel with said binding edge, and wherein said first and second binding systems extend substantially an entire length of said binding edge.

11. A component system comprising:

a component;

a first binding system coupled to said component and configured to be selectively coupled to a first binding mechanism; and a second binding system coupled to said component and movable between an extended position and a retracted position, the second binding system configured to be selectively coupled to a second binding mechanism that is different from said first binding mechanism when in the extended position;

wherein said first binding mechanism includes one or a combination of a twin wire binding and a spiral wire binding, and wherein said second binding mechanism includes a three ring binding.

12. The component system of claim 11 wherein said component includes one or a combination of a divider, a pocket, a pouch, a portfolio, a planner, a date book, a binder, a file, a notebook, a notepad, a folder, a sleeve, and a cover.

13. A component system comprising:

a component;

a first binding system coupled to said component and configured to be selectively coupled to a first binding mechanism; and a second binding system coupled to said component and configured to be selectively coupled to a second binding mechanism;

wherein the first binding system is fixedly coupled to said component and the second binding system is slidably coupled to said component;

wherein the second binding system includes a panel having a plurality of holes extending therethrough, the panel of the second binding system configured to be moved between an extended position and a retracted position.

14. The component system of claim 13 wherein said component includes one or a combination of a divider, a pocket, a pouch, a portfolio, a planner, a date book, a binder, a file, a notebook, a notepad, a folder, a sleeve, and a cover.

15. The component system of claim 13 wherein the first binding system is formed integral with the component.

16. A component system comprising:

a component having a binding edge;

a first binding system coupled to said component proximate said binding edge, said first binding system having a plurality of holes and configured to be selectively coupled to a first binding mechanism; and a second binding system coupled to said component proximate said binding edge and configured to slide between an extended position and a retracted position, said second binding system having a plurality of holes of a different size than said plurality of holes of said first binding system, the holes of said second binding system configured to be selectively coupled to a second binding mechanism;

wherein the plurality of holes of the second binding system extend at least partially beyond the binding edge of the component in the extended position, and wherein the plurality of holes of the second binding system do not extend beyond the binding edge of the component in the retracted position.

17. The component system of claim 16 wherein said first binding mechanism includes one or a combination of a twin wire binding and a spiral wire binding, and wherein said second binding mechanism includes a three ring binding.

18. The component system of claim 16 wherein said first binding system is fixedly coupled to said component.

19. The component system of claim 16 wherein each hole of the plurality of holes of said first binding system includes a center aligned along a first line thereof, said first line oriented generally parallel to said binding edge and spaced apart therefrom at a first distance; and wherein each hole of the plurality of holes of said second binding system includes a center aligned along a second line thereof, said second line oriented generally parallel to said binding edge and spaced apart therefrom at a second distance, the second distance different from the first distance.

20. The component system of claim 16 wherein said holes of said first binding system are at least about 50% larger than said holes of said second binding system.

21. The component system of claim 16 wherein each hole of said plurality of holes of said first binding system has a size and spacing configured to be coupled to said first binding mechanism; and wherein each hole of said plurality of holes of said second binding system has a size and spacing differing from said holes of said first binding system and is configured to be coupled to said second binding mechanism.

22. The component system of claim 16 wherein said second binding system includes a unitary continuous panel including said plurality of holes of said second binding system such that moving said panel correspondingly moves said plurality of holes of said second binding system.

23. The component system of claim 16 wherein said component includes one or a combination of a divider, a pocket, a pouch, a portfolio, a planner, a date book, a binder, a file, a notebook, a notepad, a folder, a sleeve, and a cover.

* * * * *